US007695410B2

(12) United States Patent
Kim

(10) Patent No.: US 7,695,410 B2
(45) Date of Patent: Apr. 13, 2010

(54) SEAT MOUNTABLE EXERCISE DEVICE

(76) Inventor: Julee Kim, 812 Dong 102 Ho, Hanyang Apartment, Soori-Dong, Goonpo-Shi, Kyeonggie-Do (KR) 435-754

( * ) Notice: Subject to any disclaimer, the term of this patent is extended or adjusted under 35 U.S.C. 154(b) by 5 days.

(21) Appl. No.: 12/388,524

(22) Filed: Feb. 19, 2009

(65) Prior Publication Data

US 2009/0239717 A1 Sep. 24, 2009

(30) Foreign Application Priority Data

Mar. 20, 2008 (KR) ..... 10-2008-0026004

(51) Int. Cl.
*A63B 22/06* (2006.01)

(52) U.S. Cl. ..... 482/57; 482/904; 482/122

(58) Field of Classification Search ..... 482/51, 482/57, 58, 59, 60, 63, 64, 65, 121, 122, 482/123, 124, 128, 129, 130; 601/23, 24, 601/27, 31, 34, 35, 36

See application file for complete search history.

(56) References Cited

U.S. PATENT DOCUMENTS 2,668,709 A * 2/1954 Boyko ..... 482/60
3,911,908 A * 10/1975 Duke ..... 601/32
4,186,920 A * 2/1980 Fiore et al. ..... 482/79
4,262,902 A * 4/1981 Dranselka ..... 482/60
4,502,681 A * 3/1985 Blomqvist ..... 482/130
4,974,840 A * 12/1990 Welch ..... 482/133
5,580,338 A * 12/1996 Scelta et al. ..... 482/62
2003/0092536 A1* 5/2003 Romanelli et al. ..... 482/60
2003/0144115 A1* 7/2003 Duvernay et al. ..... 482/79

* cited by examiner

*Primary Examiner*—Loan H Thanh
*Assistant Examiner*—Tam Nguyen

(57) ABSTRACT

A lower body exercise device for use with a seat. Other embodiments of the seat mountable lower body exercise device include a lower body exercise mechanism (20) for simultaneous use by a user while working, reading or doing other sedentary activities, and a simple installation mechanism (10) for various forms of seat. In addition, simple detachable function (11*a*), (11*c*), and multiple adjustment functions (21*aa*), (23), (30) for various user's circumstances is available, and one or more exercise alteration is also available by adjustment (30), (33*a*), (27*c*), (24*b*). Other embodiments include a magnetic cycle system which may reduce the exercise device body (21") in size.

3 Claims, 15 Drawing Sheets

【FIG 1】
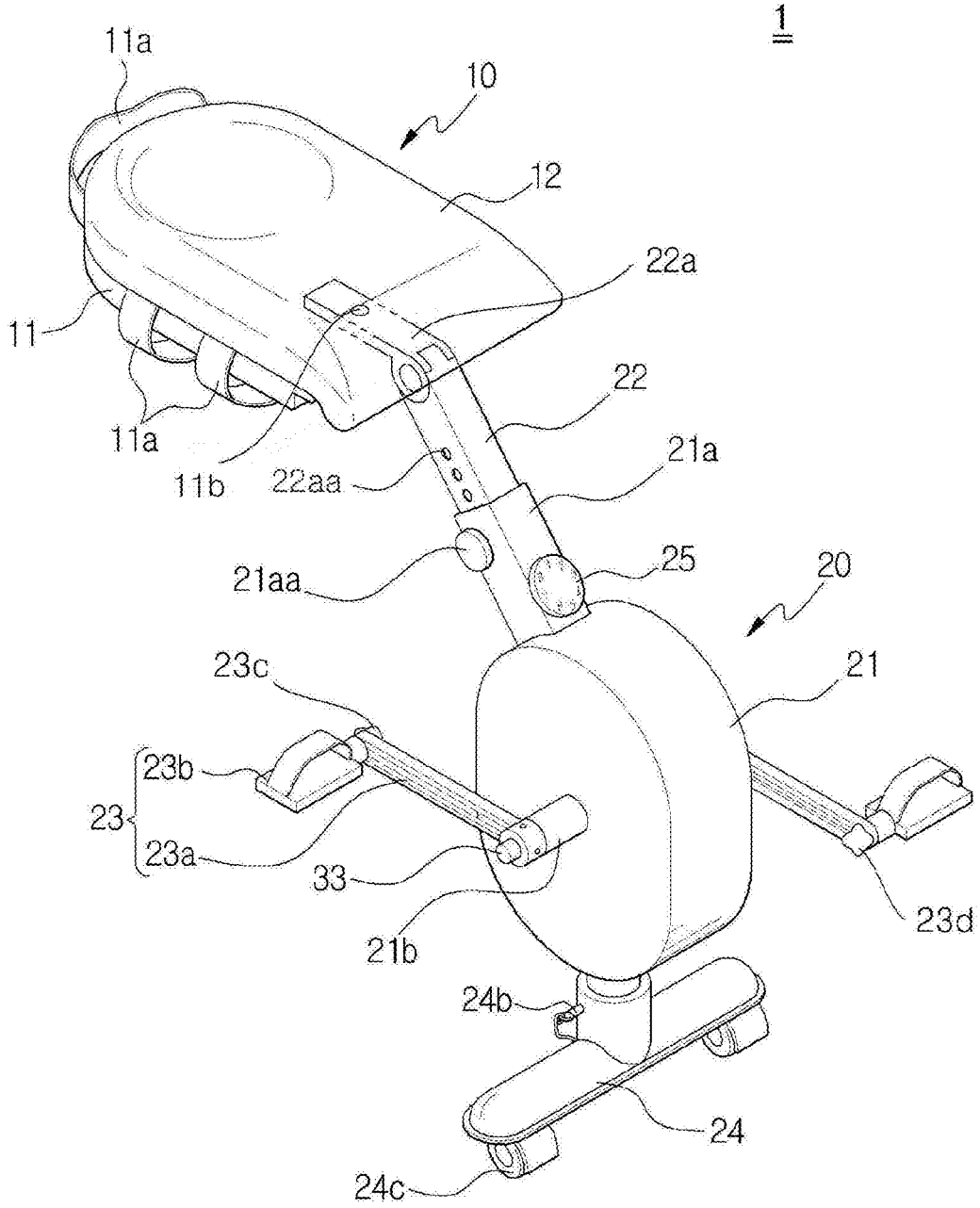

【FIG 2】
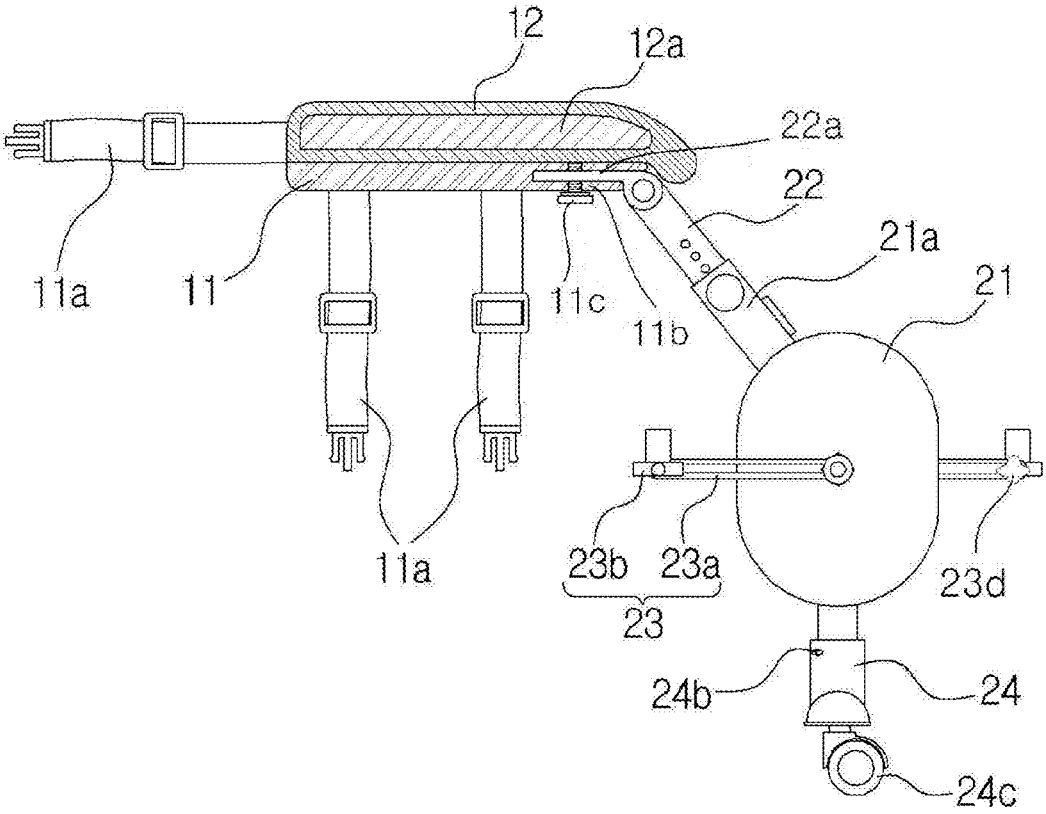

【FIG 3】
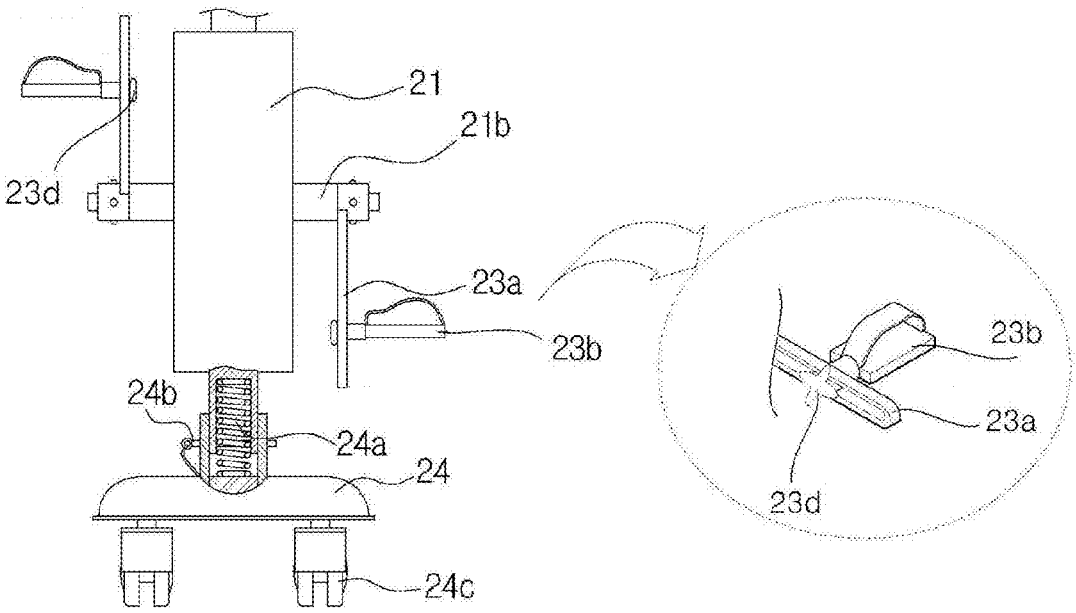

【FIG 4A】
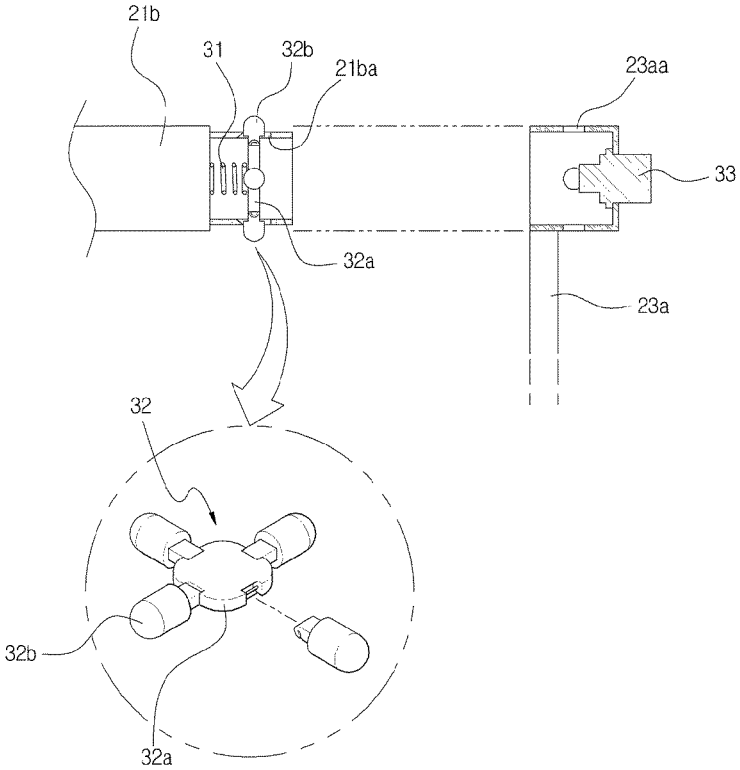
【FIG 4B】
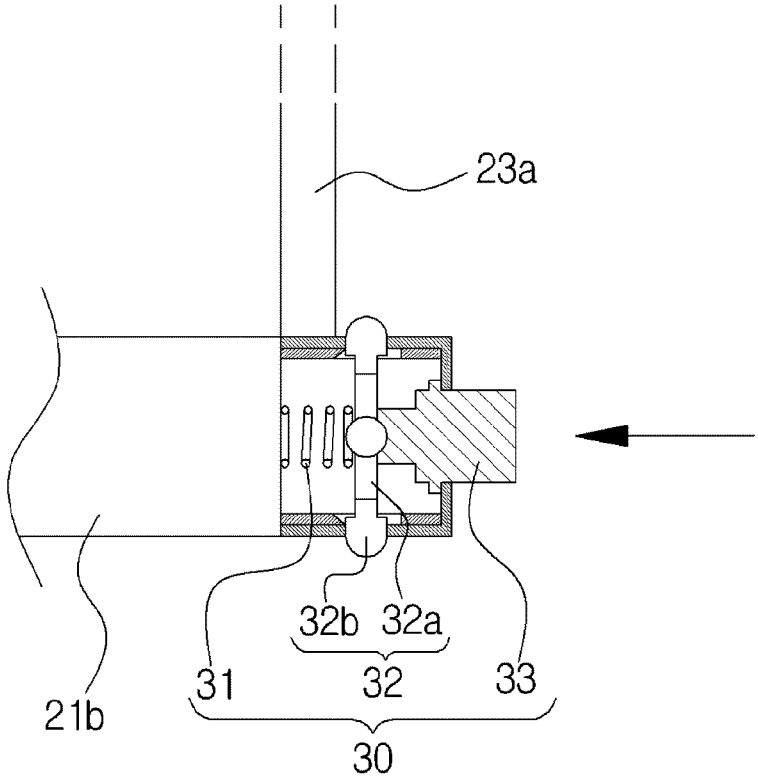

【FIG 4C】
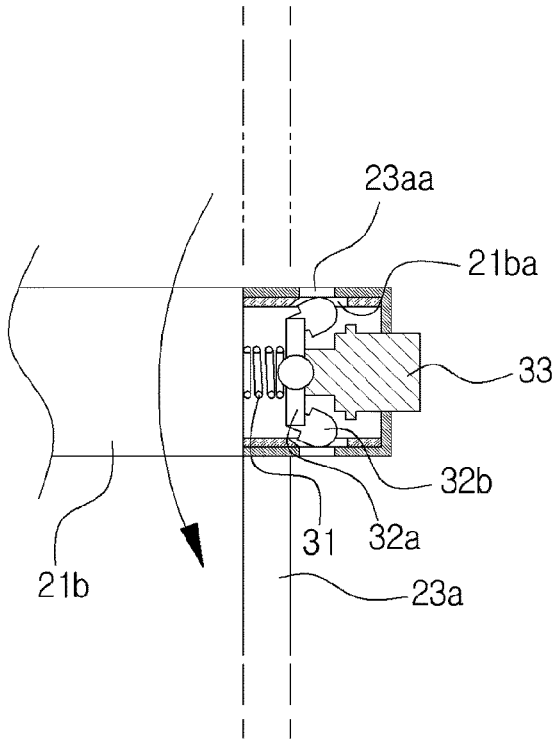
FIG 4D】
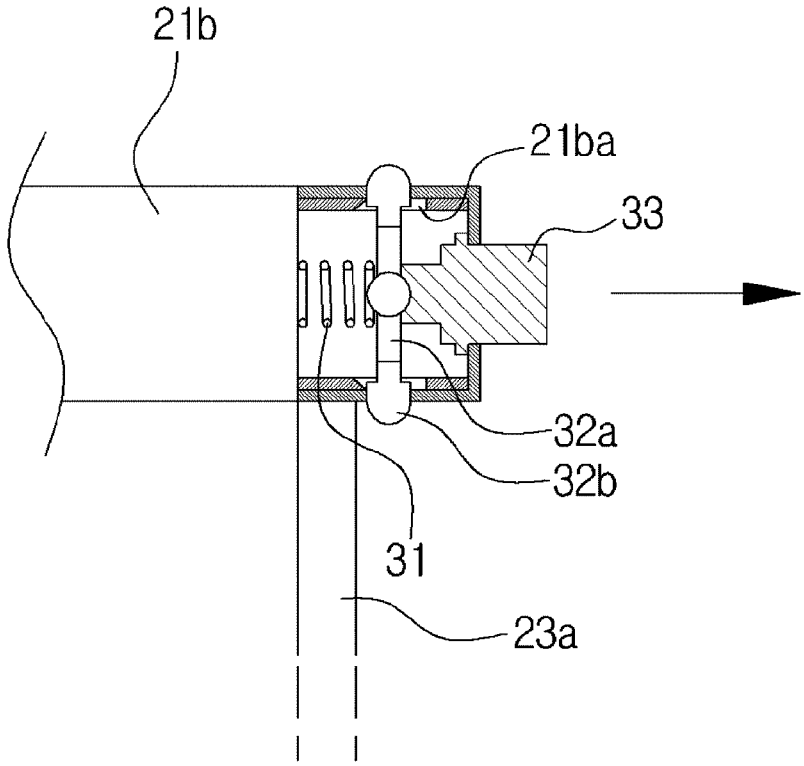

【FIG 5】
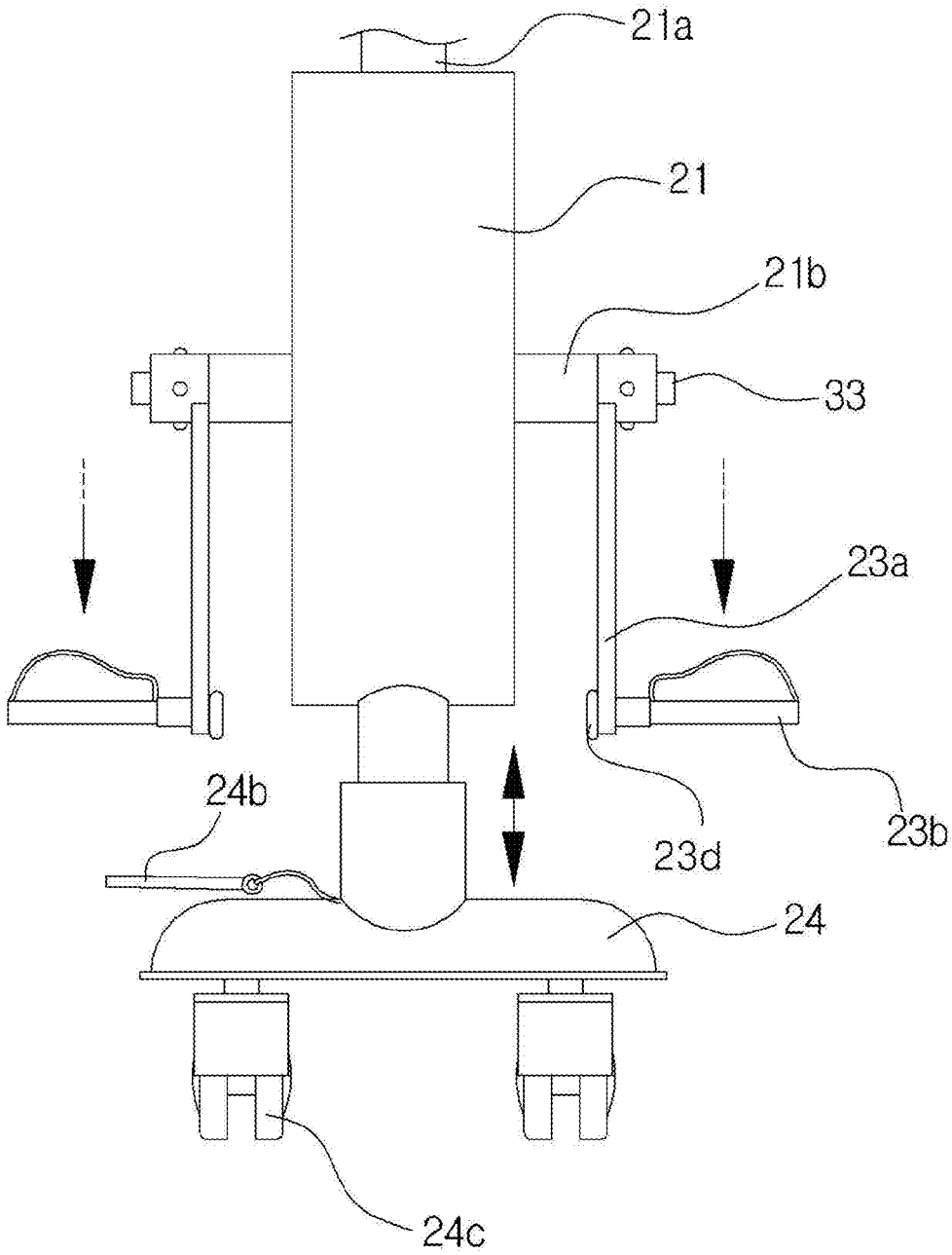

【FIG 6】
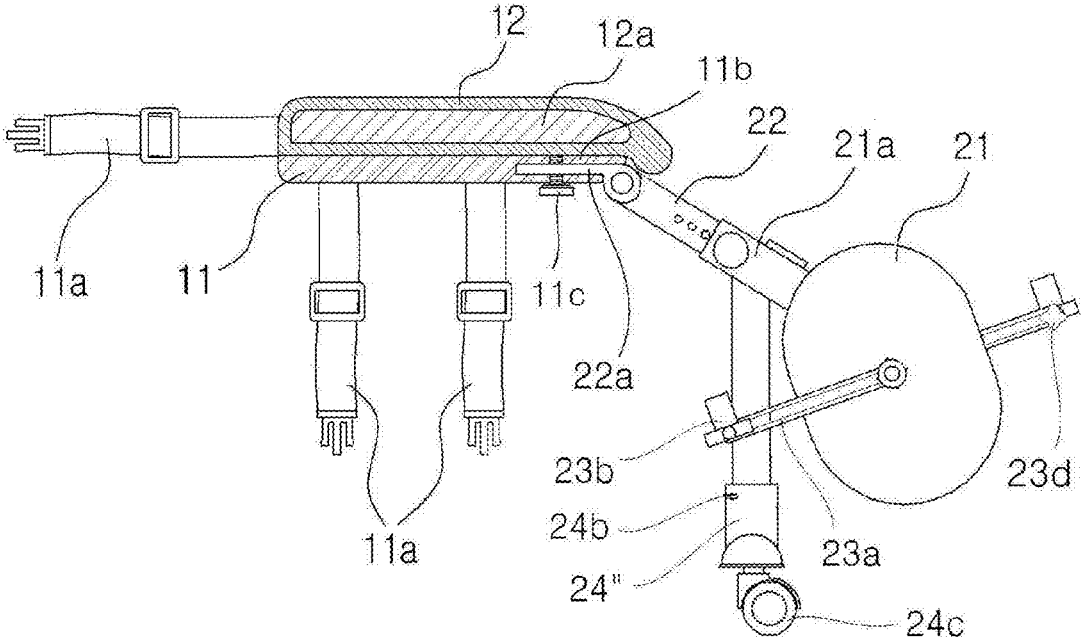

【FIG 7A】
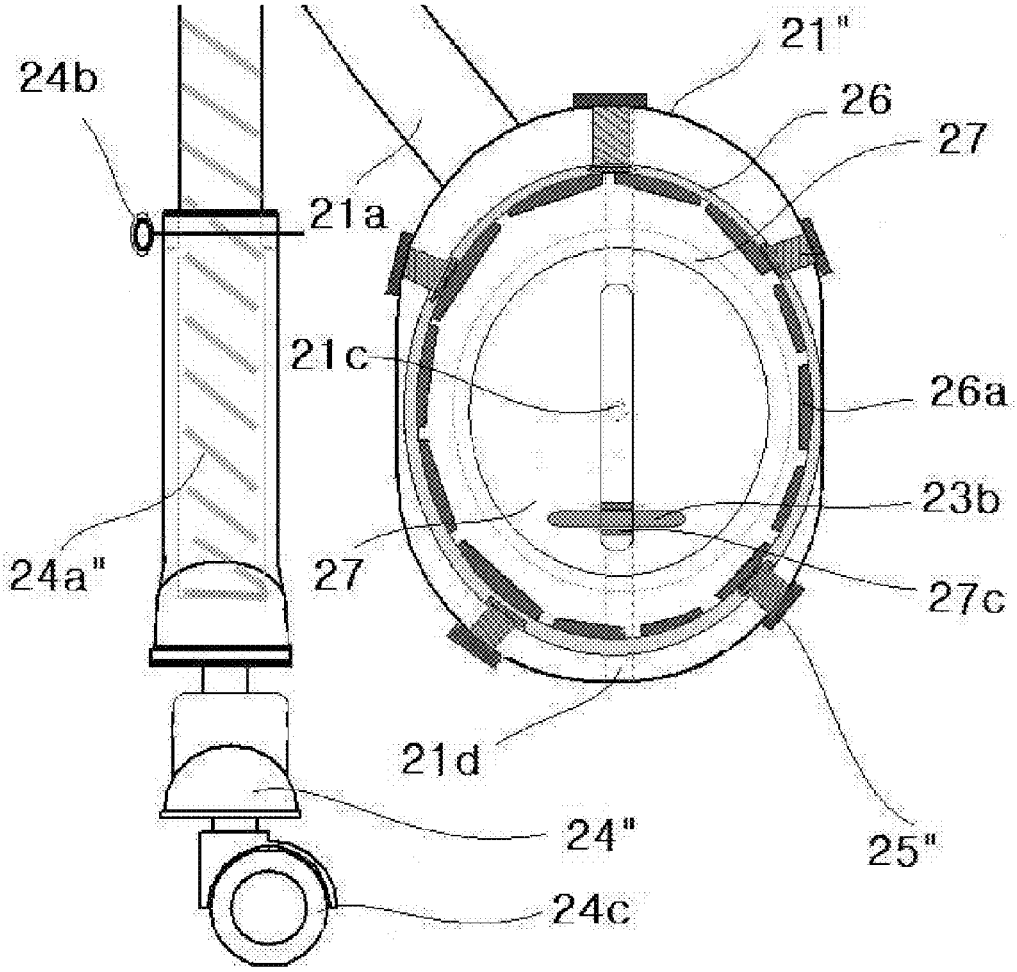

【FIG 7B】
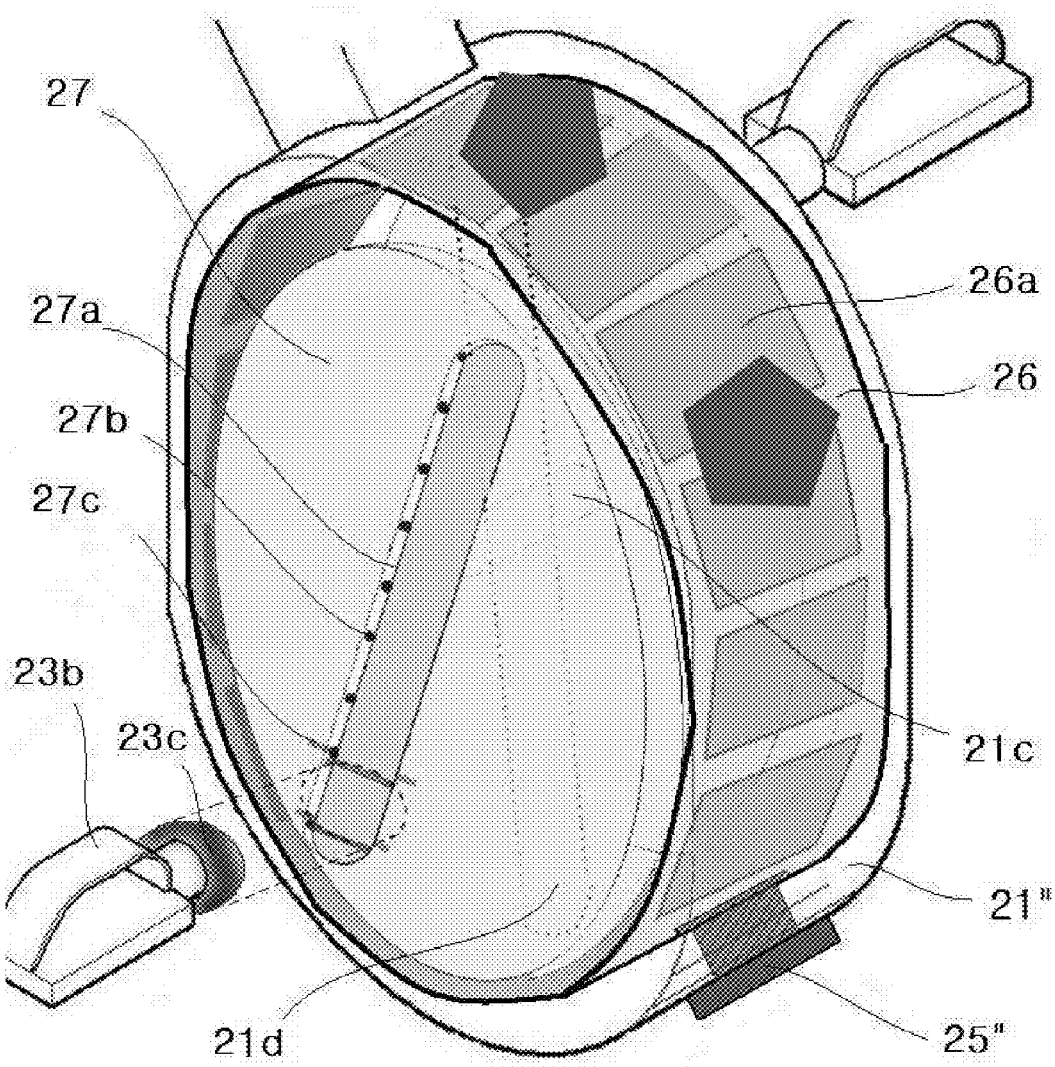

【FIG 7C】
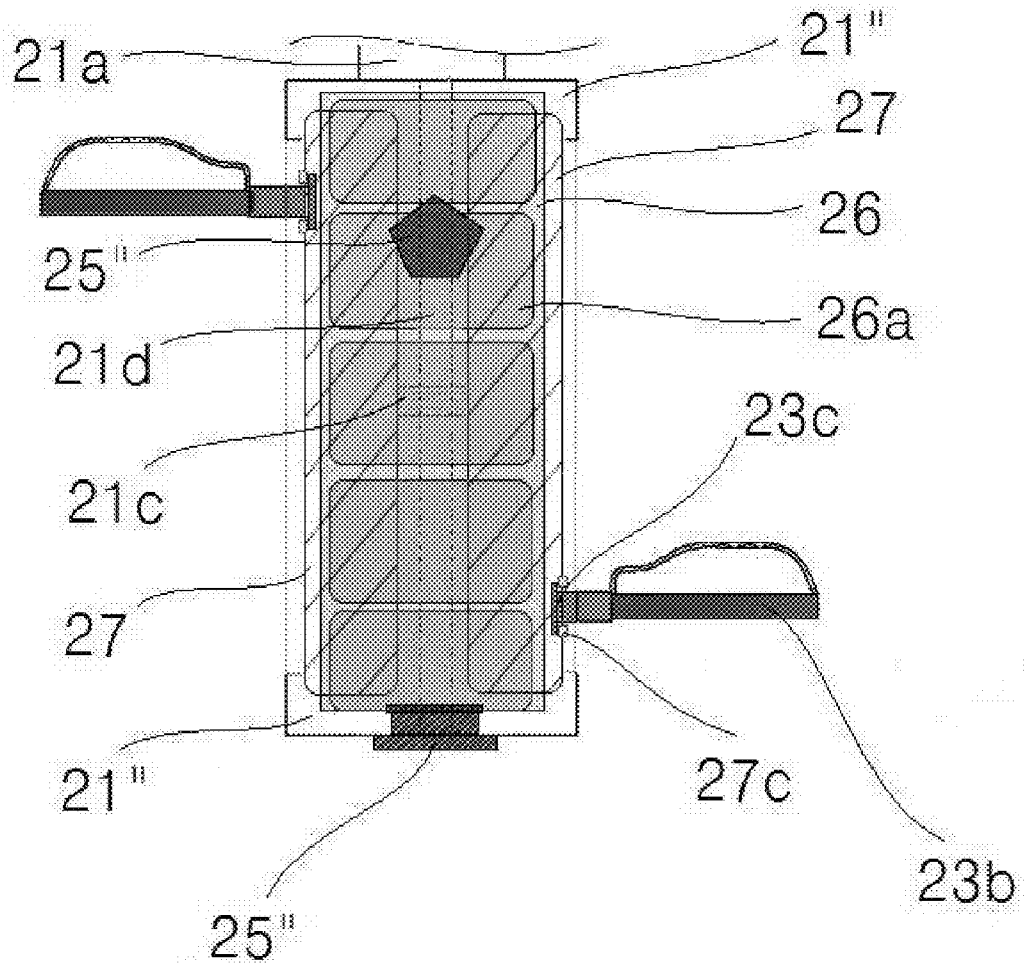

【FIG 8】
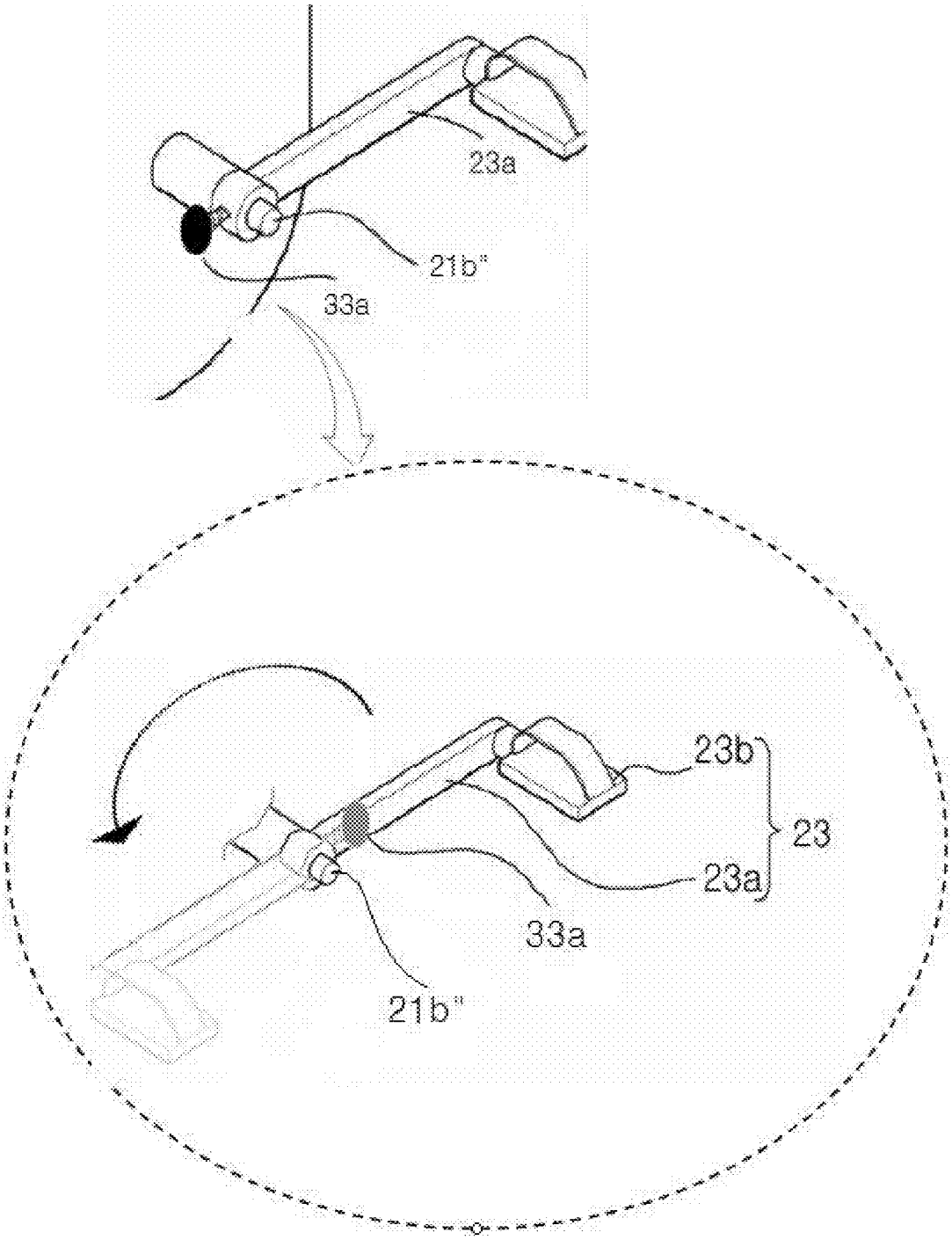

【FIG 9A】
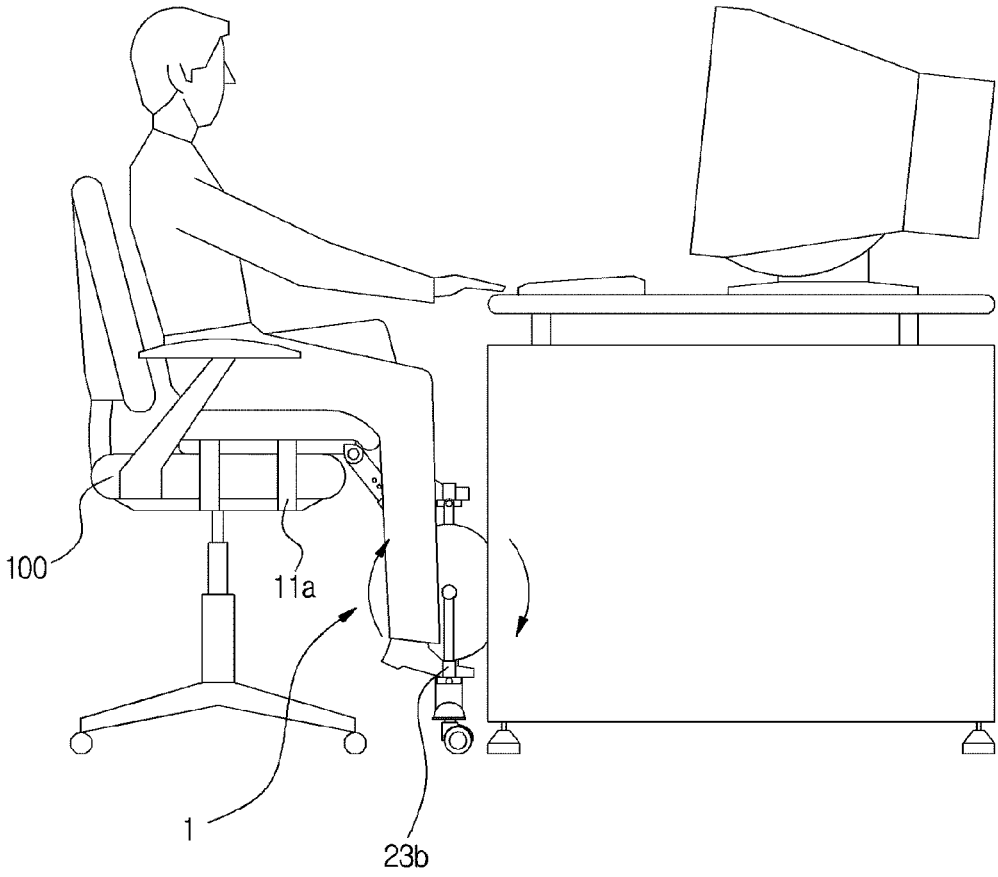

【FIG 9B】
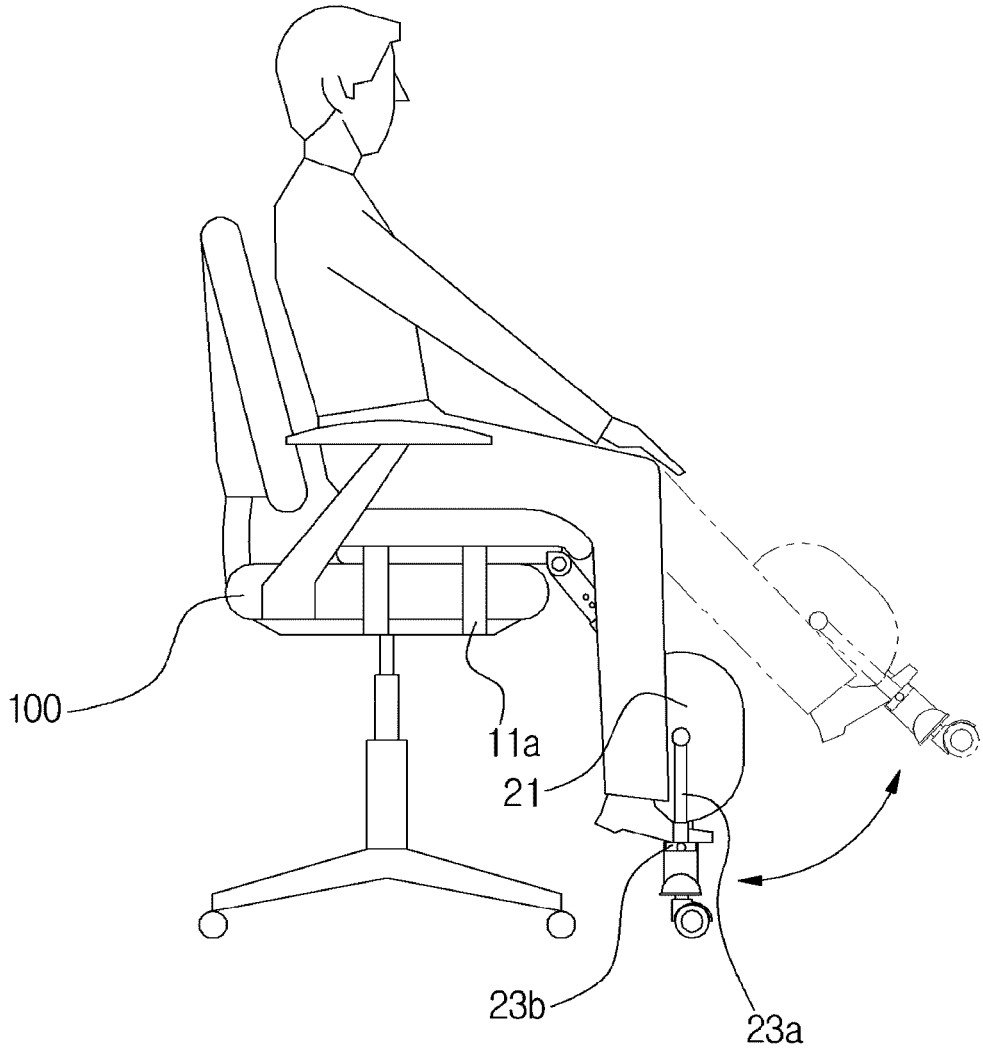

【FIG 9C】
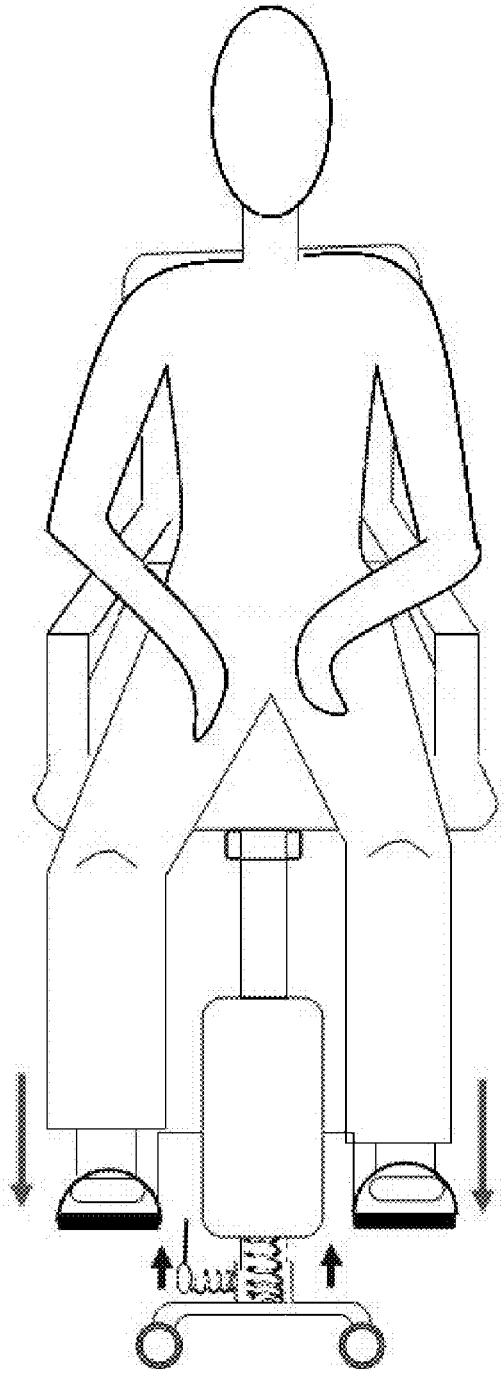

【FIG 9D】
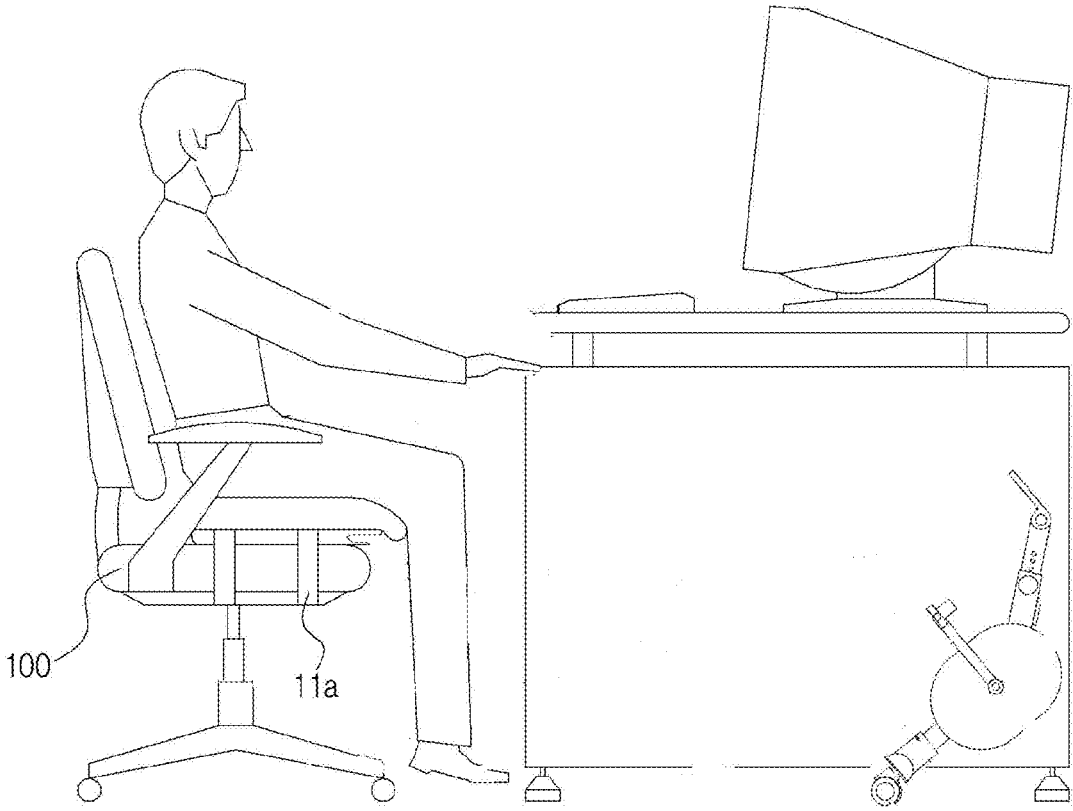

SEAT MOUNTABLE EXERCISE DEVICE

CROSS-REFERENCE TO RELATED APPLICATIONS

This is a continuation of application Ser. Nr. KR/10-2008-0026004, Filed Mar. 20, 2008, now pending 1-1-2008-0203600-14, in Rep. of Korea.

FEDERALLY SPONSORED RESEARCH

Not Applicable

SEQUENCE LISTING OR PROGRAM

Not Applicable

BACKGROUND OF THE INVENTION

1. Field

This application generally relates to exercise device, specifically to a seat mountable exercise device with alternative lower body exercise variations for use on any type of seat or chair.

2. Prior Art

Extended period of time of active hours is being increasingly required to be spent sedentarily, whether working in an office, watching television, using computer or playing videogames. Prolonged immobilization or sedentary position may not only generate discomfort, especially on the lower-body, but increasing medical studies are reporting the close connection with health risks such as blood circulatory difficulties, obesity, deep-vein thrombosis, varicose vein, mental state decrease and/or other problems. Most physical activity is available in a location or area away from office or desk, requiring additional time investment and the trouble to prepare for exercise. Considering modern day environment, it demands extra effort and time which is difficult for most people to keep up with over long period of time, whereas exercising while working at the office is being introduced as the new alternative for an efficient and convenient physical exercise.

Numerous exercise devices which provide exercise function while sitting at an office chair or simultaneous performance of physical exercises and office work have been introduced, usually by attachment of the device to either a desk or a chair, or a seat with a built-in exercising function. The following examples are of typical prior art to this field of endeavor.

| U.S. Pat. No.: | | |
|---|---|---|
| Des. 158,675 | Longfellow | Jan. 13, 1949 |
| 3,751,033 | Rosenthal | Aug. 7, 1973 |
| 3,968,963 | Sileo | Jul. 13, 1976 |
| 4,601,464 | Mousel | Jul. 22, 1986 |
| 4,913,423 | Farran | Apr. 3, 1990 |
| 5,044,633 | Rice | Jan. 9, 1991 |
| 5,108,092 | Hurst | Apr. 28, 1992 |
| 5,599,260 | Rovinsky | Feb. 4, 1997 |
| 5,690,594 | Mankovitz | Nov. 25, 1997 |
| 5,807,212 | Nelson | Dec. 4, 1996 |
| 5,833,575 | Holslag | Nov. 10, 1998 |
| 6,056,675 | Aruin | May 2, 2000 |
| 6,099,445 | Rovinsky | Feb. 4, 1998 |
| 6,866,618B2 | Rusinak-Connors | Mar. 15, 2005 |
| 9,813,059 | Willis | Sep. 26, 2002 |
| 10,698,295 | Andre | Jul. 22, 2004 |

-continued

| U.S. Pat. No.: | | |
|---|---|---|
| 10,950,931 | Neff | Mar. 10, 2005 |
| 11,766,299 | Bowser | Oct. 18, 2007 |
| 11,797,090 | Oren; Reisman | Jan. 3, 2008 |

However, most prior art describe devices that have rather limited range of movement, exercise capacity, or is applicable only for a limited type of chair or are too bulky to use under conventional office desks. Moreover, considering that the majority users would use these devices in the office where the furniture belong to the company, easy installation and removal without damaging the office furniture is important while requiring small space for diverse office circumstances. Prior arts which satisfy such requirements either have weak resistance on the pedal bearing or require the user to replace the whole chair itself, as the chair has built-in exercise system. Otherwise, some prior art describe devices that may be used in offices but require additional time for exercise, instead of simultaneous exercise with conventional office work such as computer or phone conversation.

Health related studies show that exercising the lower body, such as thighs where large amount of muscles are formed, burns more calories while it also prevents deep-vein thrombosis, varicose vein and other blood circulatory troubles, thus is especially recommended for people with extended stationary or sedentary work. Efforts to solve such exercise deficiency issue with more efficient and effective lower body movements for office workers have lead to the following prior art examples.

| U.S. Pat. No.: | | |
|---|---|---|
| 5,813,947 | Densmore | Nov. 8, 1996 |
| 10,265,501 | Kehrbaum | Apr. 8, 2004 |
| 11,380,642 | Powell | Nov. 2, 2006 |
| 11,583,764 | Perry | Apr. 24, 2008 |

Although above-noted prior art propose most efficient and effective calorie-burning exercise system that could be performed in the office, few concerns are raised. One is the eyesight failure which might occur when performing computer or desk work while walking, since minor but consistent motion would disturb and fatigue the eyes. Another concern is the budget, since the mentioned prior art require the user to purchase a new desk, system or work station which is rather costly. It also may attract undesired attention from colleagues, since the system consumes much space and requires the user to work while walking. For companies that wish to install such exercise work station system for the employees' health and benefits, the noise that the treadmill may produce is a negative aspect since it could disturb other employees. The fact that mentioned prior art are power consuming is also another aspect which needs to be addressed for eco-friendly environment.

Advantages of this application of one or more aspects are to provide a convenient mountable lower body exercise device without damaging the existing furniture, and which could be mounted to any form of chair including conventional chairs and couch. Other advantages of one or more aspects are to provide variations of lower body exercise, such as aerobic exercise and muscle training, which may be practiced simultaneously while performing other activities such as conventional office work, doing simple works at a table or desk, watching television or video games, without requiring much movement of the upper body to prevent eyesight fatigue. This application describe device which also does not require electric power and is quiet enough to exercise in the office without disturbing others. These and other advantages of one or more aspects will become apparent from a consideration of the ensuing description and accompanying drawings.

SUMMARY

In accordance with one embodiment a seat mountable exercise device comprises a cushion lever seat attachable equipment, and a leg exercise device with one or more alterable functions, which can be attached to the cushion, allowing the user to exercise while working, reading or performing other sedentary activities simultaneously.

DRAWINGS FIGURES

In the drawings, closely related figures have the same number but different alphabetic suffixes.

FIG. 1 is a perspective view of the most preferred embodiment of the seat mountable exercise device.

FIG. 2 illustrates a side view of the seat mountable exercise device illustrated in FIG. 1.

FIG. 3 is a front view of an elastic support pole and pedal length control method of FIG. 1.

FIG. 4A-4D illustrates an exploded view of the portion in the most preferred embodiment of pedal parallelization method of the seat mountable exercise device.

FIG. 5 is a portioned front view of parallelized pedals with released elastic support pole and its operation drawing of the device illustrated in FIG. 1.

FIG. 6 is a side view of another example of preferred embodiment of the seat mountable exercise device with a weight support composition connected to a different position than FIG. 1.

FIG. 7A-7C illustrates one of many examples of pedal length control system with a size reduced magnetic cycle system.

FIG. 8 is an illustration of another one of many examples of pedal parallelization method that could be replaced for pedal parallelization method illustrated in FIG. 4A-4D.

FIG. 9A-9D present examples of potential operation applications of the exercise device in FIG. 1.

| DRAWINGS-REFERENCE NUMERALS | |
|---|---|
| 1 | seat mountable exercise device |
| 10 | seat composition |
| 11 | seat base frame |
| 11a | fastening belt |
| 11b | engagement point |
| 11c | joint screw |
| 12 | seat |
| 12a | comfort support material |
| 20 | exercise device composition |
| 21 | exercise device body |
| 21" | single wheel drum body |
| 21a | lower connecting arm |
| 21aa | fixing screw |
| 21b | pedal axle |
| 21b" | pedal axle |
| 21ba | pedal lock inner hole |
| 21c | cycle system pivot center |
| 21d | cycle system vertical pole |
| 22 | pivotal connecting arm |

-continued

| DRAWINGS-REFERENCE NUMERALS | |
|---|---|
| 22a | pivotal joint |
| 22aa | length adjustable holes |
| 23 | pedal composition |
| 23a | pedal arm |
| 23aa | pedal lock outer hole |
| 23b | bearing pedal |
| 23c | pedal palm |
| 24 | support composition |
| 24" | support composition |
| 24a | spring |
| 24a" | spring |
| 24b | pin |
| 24c | wheels |
| 25 | resistance controller |
| 25" | direct resistance controller |
| 26 | magnetic belt |
| 26a | magnet |
| 27 | steel drum |
| 27a | pedal groove |
| 27b | pedal lock hole |
| 27c | pedal position lock pin |
| 30 | pedal adjustment composition |
| 31 | adjustment button spring |
| 32 | pedal lock |
| 32a | pedal lock body |
| 32b | pedal lock leg |
| 33 | adjustment button |
| 33a | pedal adjustment screw |
| 100 | chair |

DETAILED DESCRIPTION OF PREFERRED EMBODIMENT

Most preferred embodiment of a seat mountable exercise device is shown in FIGS. 1-2. The device is composed of two main levers of seat composition (10) and exercise device composition (20) for use with any conventional chair or seat, including but not limited to sofas and benches. The seat composition (10) includes a seat base frame (11), one or more fastening belts (11*a*), an engagement point (11*b*), a joint screw (11*c*) and a seat (12). The seat base frame (11) serves as the base to securely hold the fastening belts (11*a*) for installation of the seat composition (10), and as the engagement base (11*b*) to attach or detach a pivotal joint (22*a*), and also as a base to support the seat (12). The seat base frame (11) may be composed of either hard or soft material, as long as it is supportive enough to resist the tension generated at the engagement point (11*b*) and the fastening belts (11*a*). Most preferable form, but not limited to, of fastening composition would be by more than two fastening belts (11*a*), one on the bottom side to fasten with a chair's seat part, and another one on the seat (12)'s rear side to fasten with the back of a chair.

The seat pad (12) may be composed of a cushion, preferably with shock-absorbing materials such as air-gel or airbags inside the seat for comfort support material (12*a*), to produce a cushioning effect to assist a user's pelvic movements as a result of exercising the user's legs, as illustrated in FIG. 2. Another preferable form of the seat pad (12) may be composed of a higher or bulged rear part than the front part, to support better sitting posture of the user.

As illustrated in FIG. 1, the exercise device composition (20) is composed of an exercise device body (21), a pivotal connecting arm (22) with one side fixed to the exercise device body (21) and the other side with pivotal joint (22*a*), adjustable to the seat base frame (11) to connect the exercise device body (21) and the seat composition (10). A pedal composition (23) is connected to both sides of the exercise device body (21), and a device body support composition (24) is connected to the bottom of the exercise device body (21) to support the weight of the exercising device body (21). A resistance controller (25) is set on a lower connecting arm (21*a*) to control the speed or resistance of rotation of the pedal compositions (23).

The lower connecting arm (21*a*) is connected to the pivotal connecting arm (22) with a fixing screw (21*aa*) and multiple length adjustable holes (22*aa*), to adjust the length between the seat composition (10) and the exercising device body (21). Pivotal connecting arm (22) can be attached or detached to the seat composition (10) by locking the pivotal joint (22*a*) to the engagement point (11*b*) with the joint screw (11*c*). A Pedal axle (21*b*) which the pedal composition (23) is connected, is installed in both sides of the exercise device body (21). The end of each pedal axle (21*b*) is connected to a conventional gearbox or a drum magnetic type exercise system inside the exercise device body (21). As a result, when the pedal compositions (23) are revolving, pedal axles (21*b*) also revolve along.

A pedal arm (23*a*) is composed of a frame structure arm which has space in the center to allow a bearing pedal (23*b*) to slide for length adjustment by fixing with pedal length control screw (23*d*) as illustrated in FIG. 3.

As illustrated in FIG. 4A-4D, several pedal lock inner holes (21*ba*), which pedal lock legs (32*b*) of a pedal lock (32) is fixed and released according to external pressure given by the user through an adjustment button (33), lie in the section of the pedal axles (21*b*). A pedal lock outer hole (23*aa*), having the same function as the inner hole (21*ba*), corresponds to the pedal lock inner holes (21*ba*) to fix or release the pedal arm (23*a*). There may preferably be four of these pedal lock inner (21*ba*) and outer (23*aa*) holes at an angle of 90 degrees for the users to apply conveniently according to their needs.

Although not illustrated, a gearbox is installed in the exercise device body (21). This multi-level, preferably 8 level, gearbox is connected to the pedal arms (23*a*) and is made to increase the intensity of rotation of the pedal compositions (23) through the control of the resistance controller (25). The gearbox can be substituted with the said drum magnetic type system which has advantages of semi-permanent use with the least noise generation.

The support composition (24) shown in FIG. 3, is a lever to support the exercise device body (21), and most preferably, has a spring (24*a*) is installed with one end connected to the support composition (24) and the other end to the bottom of the exercise device body (21). The support composition is most preferably connected to the exercise device body (21) with a pin (24*b*), fixing the support composition (24) and device body (21) together. As illustrated in FIG. 5, by drawing out the lock pin (24*b*) of the support composition (24), the spring (24*a*) is released to allow the exercise device body (21) repeatedly ascend and descend based on the spring (24*a*) force and pressure given to the parallelized pedal composition (23) by the user. This movement is beneficial to abdominal exercises, ankle and/or knee joints, lower back and bowel movement.

One or more wheels (24*c*) may be installed at the bottom of the support composition (24) for mobility convenience.

A pedal adjustment composition (30) is used for the exercises illustrated in FIGS. 9B-9C. As shown in FIG. 4A-4D, pedal adjustment composition (30) composes of an adjustment button spring (31) built in the section of the pedal axle (21*b*), the pedal lock (32) with pedal lock legs (32*b*) hinged to a pedal lock body (32*a*), and an adjustment button (33). The pressure given to the adjustment button (33) releases the pedal arm (23*a*) from its locked position through the pedal lock (32), allowing the user to alter the direction of the pedal arm (23*a*) into parallel or desired direction, then the pedal arm (23*a*) direction is locked in its desired direction by releasing the pressure on the adjustment button (33). Pedal parallelization allows the user to benefit additional exercise functions shown in FIG. 9B-9C as an example.

FIG. 6 is another form of many examples of preferred embodiment of the seat mountable exercise device shown in FIGS. 1-2, but with the device body support composition (24") connected to the lower connecting arm (21*a*) instead of being connected to the exercise device body (21).

FIG. 7A-7C illustrate an exploded view of an alternative embodiment of the seat mountable exercise device with the bearing pedal (23*b*) directly attached to a steel drum (27) of single wheel drum body (21") including a magnetic belt (26), magnets (26*a*), a cycle system pivot center (21*c*), a cycle system vertical pole (21*d*) and multiple direct resistance controllers (25"). The single wheel drum body (21") allows cycle exercise and other exercise alterations of seat mountable exercise device with less required space than other multiple shaft method cycles. In the single wheel drum body (21"), two steel drums (27) are connected with the cycle system pivot center (21*c*) which is supported by the cycle system vertical pole (21*d*). The bearing pedal (23*b*) has a pedal palm (23*c*) which is placed in a pedal groove (27*a*) of the steel drum (27), allowing direct connection between the bearing pedal (23*b*) and the steel drum (27) by fixing the pedal palm (23*c*) with a pedal position lock pin (27*c*) to a pedal lock hole (27*b*) as shown in FIG. 7B. By controlling the pedal position, the user can either adjust the bearing pedal (23*b*) to one's needs, or can align the bearing pedal (23*b*) for exercise alteration functions shown in FIGS. 9B-9C.

The pressure given to the bearing pedal (23*b*) by the user will rotate the steel drum (27). However, the weight of the steel drum (27) and the magnetic force formed between the magnet (26*a*) planted magnetic belt (26) and the steel drum (27) creates basic cycle resistance for exercise. The direct resistance controller (25") may be set around the single wheel drum body (21") as many as the number of desired resistance level. Each direct resistance controller (25") will give exercise resistance through stronger magnetic force which is created when the magnetic belt (26) is drawn closer to the steel drum (27) through the space controlled by the resistance controller (25") attached directly to the magnetic belt belt (26).

FIG. 8 illustrates one of many examples of alternative pedal adjustment method with a pedal adjustment screw (33*a*) to loosen the pedal arm (23*a*) for alteration, then fixing the pedal arm (23*a*) direction by tightening the pedal adjustment screw (33*a*).

FIGS. 9A-9D show examples of exercises and functions which may be practiced with the seat mountable exercise device (1) from FIG. 1. It may be used while working on simple desk tasks such as computer, document, phone talks and other studies, as illustrated in FIG. 9A. It may also be installed on sofas, benches and any other form of chair or seat.

FIG. 9B-9C show alteration exercise with pedal parallelization. The user may lift the exercise device composition (20) with the legs which stimulates thigh muscles and gives tension on abdominal muscles, or may also release the pin (24*b*) and push down the elastic pole of the device body support composition (24) for abdominal and spine muscle exercise. As shown in FIG. 9D, the user may detach the exercise device composition (20) when required, and just use the seat composition (10) as a cushion.

CONCLUSION, RAMIFICATIONS, AND SCOPE

Thus the reader will see that, according to one embodiment of the invention, a convenient seat mountable lower body exercise device without damaging the existing furniture is provided, and which could be mounted to various forms of chair or seat including conventional chairs and couch. The embodiment also provides variations of lower body exercise, such as aerobic exercise and muscle training, which may be practiced simultaneously while performing other activities such as conventional office work or video games, without requiring much movement of the upper body to prevent eyesight fatigue. In addition, the embodiment is also eco-friendly since it does not require electric power and is semi-permanent. Furthermore, the reader will also see that the embodiment will help playing a role in preventing obesity and promoting public health through promotion of constant movement of the lower body, stimulating blood circulation for most busy sedentary users.

While the above description contains much specificity, these should not be construed as limitations on the scope of any embodiment, but as exemplifications of the presently preferred embodiments thereof. Many other ramifications and variations are possible within the teachings of the various embodiments. For example, the seat mountable exercise device may have various designs, colors, sizes and shapes, such as various shapes or material of cushion; various forms of pedal parallelization methods, adjusting with screw, button, clip, etc.; various designs of exercise body support composition, which may contain only one wheel, many wheels or no wheel at all; various forms of attaching systems may be applied for exercise composition connection method with the seat composition, such as clip method, hook method or belt method, etc; it may have one or more support pole compositions; other elastic methods may be applied for the support pole, such as strong elastic belt or air resistance system; methods of fixing and releasing the elastic pole may be replaced with other methods than pin, such as tightening lid, fixing button or screw, etc.; various shapes of bearing pedal; any appropriate materials may be used for said device including the steel wheel, which may be substituted for iron or any other magnetic material; various forms of intensity control, such as simple button system instead of screw type, belt resistance instead of magnetic force, etc.; magnetic belt may not be consecutive but fragmented into multiple sections or it may be placed vertically rather than horizontally, etc.; various cycle systems such as belt system, semi-magnetic cycle system, drum magnetic system, etc.; it may also have a different mode or function of operation, such as addition or exclusion of alternative exercises other than cycle exercise function, a lever of the embodiment may or may not be attach/detachable, or the exercise component may have an additional joint to move sideways for altered muscle exercise, etc.

Thus the scope of the embodiments should be determined by the appended claims and their legal equivalents, rather than by the examples given.

The invention claimed is:

1. A seat mountable exercise device comprising:

a seat composition having a seat frame and a seat pad for supporting a user, a coupling means, attached to the seat frame, for securing the seat composition directly to a substantially planar seating portion of a conventional seat or chair and an angularly adjustable exercise device arm;

said exercise device arm includes an exercise mechanism, having rotatable pedals, at a distal portion of the exercise device arm and an attachment means disposed at an opposite end of the exercise device arm for coupling the exercise device arm to the seat frame; and said exercise device arm further includes a vertical supporting assembly extending downwardly from the exercise mechanism, said vertical supporting assembly includes telescoping components that house a pin-releasable elastic force member such that the vertical supporting assembly may provide a rigid support of the exercise device on a support surface when a pin locks the telescoping components together and provides an oscillating elastic force to the exercise device arm and exercise device when the pin is removed to allow the telescoping components to move relative to each other, thereby allowing for exercises other than rotating the pedals of the exercise mechanism, wherein said device will allow for substantially convenient installation on various forms of seating by simply mounting said seat composition over a seat, and providing pedal rotation and other forms of non-pedal rotating exercises such as abdominal exercises when the user manipulates the elastic force member of the vertical supporting assembly while simultaneously working, reading or doing other sedentary activities.

2. A seat mountable exercise device of claim 1, wherein the exercise mechanism further includes a pedal axle and a pair of pedal arms such that each pedal arm attaches a respective pedal to the pedal axle 180 degrees offset from the other pedal arm to provide conventional pedal rotating exercise; and each end of the pedal axle includes a spring-loaded means for adjusting the connection between the pedal arms and the pedal axle such that the pedal arms and the pedals are not offset from each other but rather aligned to rotate or be used in other non-pedal rotating exercises in tandem, side by side.

3. A seat mountable exercise device of claim 2, wherein the pedal arms include means for adjusting the length of the pedal arms such that the lengths can be adjusted equally to increase or decrease the distance between the pedals and the pedal axle to allow for non-pedal rotating exercises.

* * * * *